United States Patent [19]

Cyphelly

[11] Patent Number: 4,948,341

[45] Date of Patent: Aug. 14, 1990

[54] WATER PUMPING SYSTEM INCLUDING A SUCTION RAM

[76] Inventor: Ivan J. Cyphelly, CH-1588 Cudrefin, Switzerland

[21] Appl. No.: 193,707

[22] Filed: May 13, 1988

[51] Int. Cl.[5] ..... F04F 7/00

[52] U.S. Cl. ..... 417/104

[58] Field of Search ..... 417/225, 226, 227, 85, 417/104, 240, 241

[56] References Cited

U.S. PATENT DOCUMENTS

| | | | |
|---|---|---|---|
| 531,735 | 1/1895 | Mortensen | 417/104 |
| 799,428 | 9/1905 | Wolski | 417/104 |
| 1,953,453 | 4/1934 | Whipple | 417/104 |
| 3,123,009 | 3/1964 | Watson | 417/240 |
| 4,121,895 | 10/1978 | Watson | 417/104 |

FOREIGN PATENT DOCUMENTS

| | | | |
|---|---|---|---|
| 804288 | 2/1951 | Fed. Rep. of Germany | 417/104 |

*Primary Examiner*—Leonard E. Smith
*Attorney, Agent, or Firm*—Browdy & Neimark

[57] ABSTRACT

A pumping system for water in a pit comprises a feeding unit to be installed above the ground and a suction ram assembly to be immerged into water partially filling the pit. The suction ram assembly has a ram valve (4a, 4b) and a foot valve (12, 13) which are connected to the feeding unit through the concentric arrangement of a feeding hose (1) and a riser pipe (2). The ram valve comprises two annular coaxial sleeve parts (4a, 4b) each having a valve seat (7, 8), and annularly surrounds the riser pipe (2). An electrolytical gas cushion vessel (17) having an electrode (18) is attached to the riser pipe (2) which forms an associated electrode. The vessel (17) also contains a float (21) which is connected to the ram valve (4a, 4b) over cables (22). The unit of the riser pipe (2), the ram valve (4a, 4b), the foot valve (12, 13) and the vessel (17) is plugged into a funnel-shaped sleeve (15) which is fixed to the feeding hose (1). The pumping system has a high efficiency and presents an adjustable threshold force of the ram valve (4a, 4b). If required, the assembly of the ram including the riser pipe (2) may be easily pulled from the pit.

9 Claims, 1 Drawing Sheet

WATER PUMPING SYSTEM INCLUDING A SUCTION RAM

BACKGROUND OF THE INVENTION

The present invention relates to a water pumping system for a pit such as a well or a borehole containing water at its bottom which has to be pumped to the surface of the pit. The system includes a feeding unit to be installed above the ground which surrounds the pit, and a suction ram assembly to be immerged into the water in the pit. The suction ram assembly comprises a ram valve and a foot valve. A riser pipe which is concentrically placed in a feed hose connects the surface feeding unit with the underwater suction ram assembly.

A water pumping system of that concentrical kind is known from German Patent No. 804,288. As is well known with such suction ram assemblies the ram valve shows a shut-off threshold force which in the pumping system of the above-mention German patent is determined by the poppet weight of the ram valve.

That system and similar systems cannot secure a fail-safe operation for several reasons. The intricate physical laws governing an automatic operation of a suction ram impose amongst other conditions an adjustment of the valve shut-off threshold dependent on various working parameters and a surge-free feeding pressure, if a correct self-alternance of the opening periods of the ram valve and the foot valve has to be maintained under severe conditions including polluted sump water, air inclusions and feed irregularities. Pumping devices to be installed at the bottom of a pit are of no practical use, if their self-oscillating operation is subject to failures or if they have to be lifted out of the pit whenever the poppet of the ram valve should become clogged. Moreover known pumping systems do not comprise any means for efficiently starting or restarting the suction ram assembly from the surface ground of the pit nor for adjusting the shut-off threshold force of the ram valve or for performing a gas cushion control from the surface ground.

SUMMARY OF THE INVENTION

It is an object of the present invention to provide for a water pumping system of the kind described above which can be easily installed in a pit such as a well or a borehole.

It is another object of the invention to provide for a water pumping system showing reliable oscillatory operation combined with the feature of forced restarting.

It is a further object of the invention to provide for such water pumping system showing efficient operation within the limited space of a borehole with very low hydraulic losses as a result of smooth flow pattern including only minimum changes in flow speed and flow direction.

These and other objects are achieved by the present invention in a water pumping system of the kind described above wherein the suction ram assembly and the riser pipe connected thereto are adapted to be plugged at the lower end of the riser pipe into a funnel-shaped sleeve which is clamped to the feed hose at the lower end thereof. Thereby lifting the riser pipe above ground simultaneously lifts the ram valve and the foot valve. The feed hose subsequently becomes vented from any water column contained therein. Advantageously the ram valve comprises two sliding sleeve parts surrounding the riser pipe. Each sleeve part has a valve face associated with a corresponding valve seat formed on the riser pipe. The sleeve parts are coupled one to the other by a sealing member and rest on a common spring located therebetween to determine a shut-off threshold force for the associated valve faces and valve seats.

BRIEF DESCRIPTION OF THE DRAWINGS

The attached drawings illustrate a preferred embodiment of the invention in which.

DETAILED DESCRIPTION OF THE PREFERRED EMBODIMENT

Figure 2:
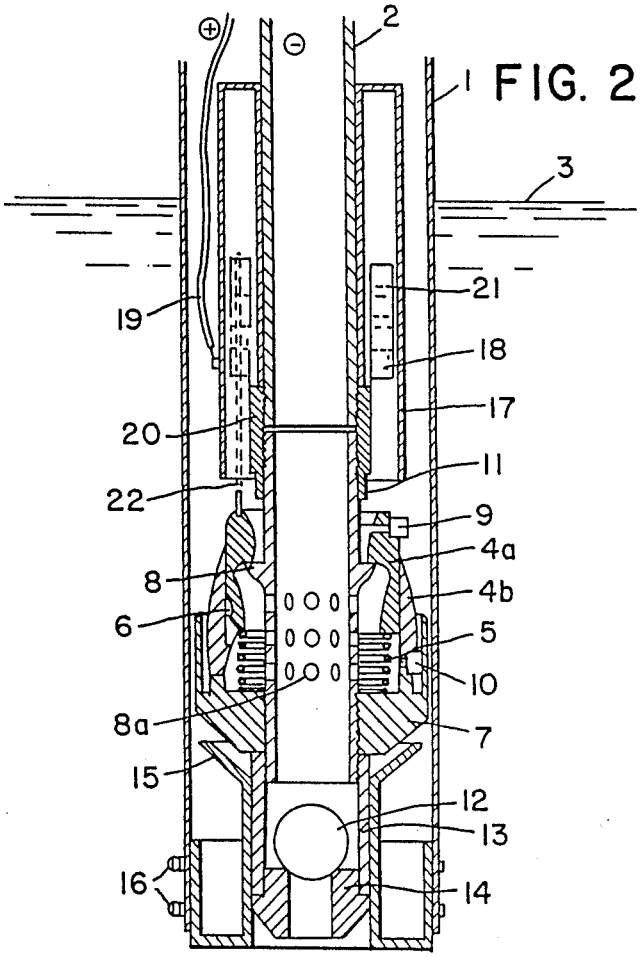
FIG. 2 is a cross-sectional view through the axis of an annular suction ram including an electrolytically controlled gas cushion vessel and a threshold adjustment combined therewith.

According to FIG. 2 the suction ram assembly comprises five elements stacked at the lower end of a riser pipe 2 and plugged into a sleeve 15 which is fixed to the lower end of a feeding hose 1. The whole assembly is below the water level 3 of a well, a borehole or a river.

The afore-mentioned five elements are:

(1) A ram valve the body of which is splitted into two sliding sleeve parts 4*a* and 4*b* which surround the riser pipe 2 in an annular manner. That composite valve rests on a spring 5 which is supported by a socket 7. The two sleeve parts of the ram valve are linked together exclusively by the friction and/or by the elasticity of a seal 6. The sleeve part 4*a* mates with an extension of the riser pipe 2 which is a seat pipe 8 having side ports 8*a*. Both sleeve parts 4*a* and 4*b* are guided radially against the ported seat pipe 8 and the rim of the socket 7 by two pairs 9 and 10, respectively, of three centering pins or bumps. A resilient ring 11 on the riser pipe 2 limits the opening of the sleeve parts 4*a* and 4*b* of the ram valve. The seat areas on both sleeve parts 4*a* and 4*b* thus are allowed to mate individually with the corresponding seats on the socket 7 and the seat pipe 8, respectively, to form a perfect and stress-free sealing.

(2) A foot check valve 12 which is shown in FIG. 2 as ball and seat arrangement having its lower suction bore in a valve body 13, the opening of the bore being adapted to be closed by the check valve 12.

(3) A plug-in connector arranged between the valve body 13 and the feeding hose 1 and thus arranged between the riser pipe 2 including the sleeve parts 4*a* and 4*b* of the ram valve, and the feeding hose 1. The plug-in connector comprises a funnel-ended portion 15 and a seal 14 which is arranged between the funnel-ended portion 15 and the valve body 13 of the foot check valve 12. The funnel-ended portion 15 forms at the same time a bottom of the feeding hose 1 and is clamped thereto by hose clamps 16.

(4) A tubular gas cushion vessel 17 surrounding the riser pipe 2, the vessel 17 being of an electrolytic feed type. The vessel consists of an insulating material and has an annular electrode 18 to which a cable 19 is connected. The vessel 17 also has a contacting sleeve 20 which is in electrical contact with the riser pipe 2 and connects the riser pipe 2 with the seat pipe 8.

(5) A device for adjusting the shut-off threshold of the sleeve parts 4*a* and 4*b* of the ram valve comprising a float or buoy 21 disposed in the gas cushion vessel 17 and cables or shafts 22 which mechanically connect the float or buoy 21 to the sleeve part 4*a* of the ram valve, thereby adding the pull of the variable immersion of the float or buoy 21 to the force of the spring 5.

Figure 1:
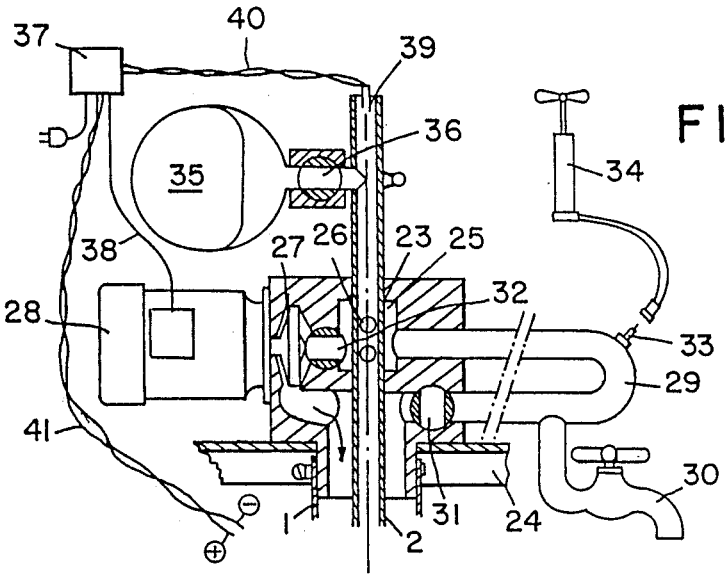
FIG. 1 is a cross-sectional view of a feeding unit including a centrifugal pump and ancillary equipment resting on a supporting beam which overhangs the bore mouth of a well head.

According to FIG. 1 a surface-based feeding unit comprises a feeding block 23 resting on a support beam 24 which crosses the bore mouth (not shown) of the well head. The feeding hose 1 is clamped to a lower socket piece protruding from the feeding block 23. The riser pipe 2 passes through a chamber 25 in the feeding block 23 in the upward direction and has openings 26 in the chamber 25 which are providing for hydraulic contact with the chamber 25. A centrifugal pump 27 driven by an electrical motor 28 is arranged in the feeding block 23 for draining a flow of water from the riser pipe 2 into the feeding hose 1. A consumer pipe 29 starts in the chamber 25 of the feeding block 23 and is provided with a cock 30 for bleeding water from chamber 25 and riser pipe 2. The consumer pipe 29 also communicates with the feeding hose 1 over a valve 31. A second valve 32 controls the water flow between the chamber 25 and the centrifugal pump 27. The consumer pipe 29 also includes a nipple air valve 33 to which an air pump 34 may be connected for introducing air into the consumer pipe 29. An accumulator 35 is connected over a third valve 36 to the upper end portion of the riser pipe 2 which extends upwardly over the feeding block 23.

An electrical control box 37 which may be connected to an electrical power supply includes a contactor (not shown) for turning on and off the centrifugal pump 27 over a cable 38. For controlling the contactor in the control box 37, two electrodes 39 are arranged in a closed upper end of the riser pipe 2, the electrodes 39 being connected to the control box 37 over wires 40. In addition two direct-current supply wires 41 extend from the control box 37. The wire 41 having a positive polarity is connected to the cable 19 of the electrode 18 in the gas cushion vessel 17 (FIG. 2). The other wire 41 having a negative polarity is connected to the riser pipe 2 (FIG. 2).

The pumping system shown in FIGS. 1 and 2 operates as follows.

Assuming an opened position of the ram valve formed by sleeve parts 4*a* and 4*b* which abuts against the resilient ring 11, the centrifigal pump 27 driven by the electrical motor 28 feeds and accelerates water in a closed circuit from the accumulator 35 and the chamber 23 to the feeding hose 1, through the sleeve parts 4*a* and 4*b* of the ram valve to the riser pipe 2 and eventually back to the chamber 23. When the pressure drop at the ram valve sleeve parts 4*a* and 4*b* reaches the threshold set by the spring 5, an instantaneous shut-off of the ram valve with the sleeve parts 4*a* and 4*b* is produced. The inertia of the still moving water column in the riser pipe 2 tends to maintain the water velocity in the riser pipe at the value before shut-off. Therefore, a suction of the now missing displacement volume from the surrounding space of the well through the foot valve 12 into the riser pipe 2 occurs, the sucked water volume being conveyed into the accumulator 35 until the water column in the riser pipe 2 has lost any movement in the upward direction. The kinetic energy of the much slower feeding column in the feeding hose 1 is stored in the gas cushion vessel 17.

When the water column in the riser pipe 2 stops, a compression set-back reopens the ram valve sleeve parts 4*a* and 4*b* with the aid of the spring 5, and a new pumping cycle is started, whereby the accumulator 35 is filled under pressure with water by the difference of water flow in the riser pipe 2 and the feeding hose 1. Water may then be drawn through the cock 30 at any height above ground.

Figure 3:
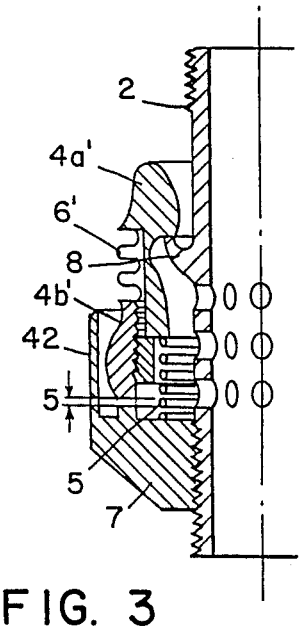
FIG. 3 is an enlarged cross-sectional view of a further embodiment of an annular ram valve including a bellows sealing.

The knock produced by the compression set-back in the riser pipe 2 may be too small for safely opening the ram valve sleeve parts 4*a* and 4*b* as, for example, in view of air bubbles in the water column or in view of an excessively high water level 3. Such irregularities may disturb the ram valve rhythm or even produce a full stop of the ram valve. In order to avoid any problems under such conditions, a bellows-sealed ram valve having sleeve parts 4*a*′ and 4*b*′ as shown in FIG. 3 is recommended with a resilent bellows 6′ which replaces the friction seal 6 of FIG. 2. The bellows 6′ is pulled by an adjustable threaded ring 42 so as to impose a strong opening force for a small stroke portions of the sleeve part 4*b*, once the sleeve part 4*a*′ reaches its seat on the seat pipe 8. Hence, the ram valve assembly 4*a*, 4*b*′ will automatically open when the depression due to suction disappears in the riser pipe 2. Therefore, the cyclic operations do not rely any more upon the compression set-back, and the rhythm of the ram will not be affected by even the harshest conditions.

Pollutions and incrustations can lead to a complete jamming of the ram valve sleeve parts 4*a* and 4*b*, especially after a long period of inactivity.

If the ram valve assembly 4*a*, 4*b* is clogged in the open position, it will be sufficient to pressurize the riser pipe 2 with valve 31 (FIG. 1) being in its closed position. This may be easily achieved by connecting the air pump 34 to the air valve 33. Thereby, the air cushion in the vessel 17 will be compressed whose accumulated power can be suddenly released by opening the cock 30, thus forcing the ram valve assembly 4*a*, 4*b* to close. The same means can be used to fill the whole system with water when no surface water is available. Even with a small dip, alternate air pressurizing and releasing will allow for short pumping periods, thus enhancing every time both feeding and rising water columns to full operative capacity.

If the ram valve assembly 4*a*, 4*b* is jammed in its closed position, that disturbance may normally be eliminated by short-circuiting the feeding and rising areas by means of opening the valve 31 or by means of starting and stopping the electrical motor 28. The pressure balance on both sides of the ram valve assembly 4*a*, 4*b* then usually enables the spring 5 to open the valve assembly. If a higher effort is required, a ram pressure surge may be produced by an idling flow of water through the pipe 29 and through the opened valve 31. Suddenly closing the valve 31 will then produce a strong pressure surge in the riser pipe 2 which opens the jammed ram valve assembly 4*a*, 4*b*.

If the water level 3 in the well falls to the level of suction, air will enter through the foot valve 12 and accumulate at the closed upper end of the riser pipe 2. The electrodes 39 are then no more immerged into water, and in view of the absence of electrical conduction, the electrodes 39 will cut off the electrical motor 28 and stop the centrifugal pump 27. As the accumulated air dissolves in the water, the air will disappear sufficiently after some time to allow the electrodes 39 to become immerged again. The electrical motor 28 will then be turned on and the centrifigal pump will start again. Thus even smallest yields of water can be pumped reliably.

As normally the whole suction ram assembly is located well under the water level 3, the immersion depth can reach the well depth during rain periods. Therefore, measures have to be taken to control the air cushion volume in the tubular vessel 17 from the surface, e.g. by pumping air periodically through a small hose which connects an air pump to the vessel 17. A safer way, however, is to replace the small hose by the cable 19 which applies a positive potential to the annular electrode 18 in the vessel 17 as has been described with respect to FIGS. 1 and 2. As the electrode 18 faces the contacting sleeve 20 which is in contact with the riser pipe 2 and thus at a negative potential as previously described, an electrical current supplied by the control box over the wires 41 and flowing in the water then between the electrode 18 and the sleeve 20 will electrolytically generate gas in the vessel 17 as long as the water level does not fall under the level of the electrode 18. Knowing the high dissolution rate of oxygen in the water and the longitudinal shape of the electrode 18, the extension of the gas cushion above the electrode 18 in the vessel 17 can be controlled by electrolytic current.

The possibility of displacing the water level within the tubular cushion vessel 17 provides an easy way of controlling the ram shut-off threshold. For this purpose the variable displacement force of the float 21 is added to the fixed rate of the spring 5, the float 21 being linked to the ram valve assembly 4*a*, 4*b* through the cables or shafts 22 as described before. This threshold control permits an adjustment of the pumped flow to the drawdown, to the available power or to any other well parameter.

Thanks to its simple design combined with high efficiency, the pumping system according to the invention is meant to be substituted for submersible centrifugal pumps or jet pumps, especially in the low power range. These features combined with easiest maintenance due to absence of parts subject to wear make the present system very suitable for areas and countries having low technical structure and having alternative power sources. For example, the surface based motor 28 may be supplied with direct current from batteries or solar arreys.

I claim:

1. A water pumping system for a pit such as a well or a borehole, including a feeding unit to be installed above the ground surrounding the pit and a suction ram assembly having a lower end to be immersed into water partially filling the pit, said suction ram assembly having a ram valve and a foot valve and being connected to said feeding unit through a feeding hose and a riser pipe at respective lower ends thereof, said riser pipe being concentrically and spacedly located within said feeding hose, said foot valve being arranged between said lower end of said riser pipe and an outer space at said lower end of said suction ram assembly for controlled water flow from said outer space to said riser pipe, and said ram valve being arranged between said riser pipe and said feeding hose above said lower end of said riser pipe for controlled water flow from said feeding hose to said riser pipe, wherein said ram valve comprises two axially spaced valve portions each having an axially sliding annular sleeve part coaxially surrounding said riser pipe, each sleeve part having a valve face associated with a corresponding valve seat formed on said riser pipe, said riser pipe being provided with openings to said feeding hose located axially between said associated valve seats, and wherein said feeding hose comprises a funnel-shaped sleeve clamped thereto at said lower end thereof, said funnel-shaped sleeve receiving said lower end of said riser pipe including said suction ram assembly, whereby lifting said riser pipe above ground simultaneously lifts said ram valve and said foot valve, and whereby said feeding hose subsequently becomes vented from any water column contained therein.

2. A system in accordance with claim 1 wherein, each sleeve part has a valve face associated with a corresponding valve seat formed on said riser pipe, said sleeve parts are coupled one to the other by a sealing member and said sleeve parts rest on a common spring located therebetween to determine a shut-off threshold force for said associated valve faces and valve seats.

3. A system in accordance with claim 2 wherein said sealing member is a frictional sealing member.

4. A system in accordance with claim 2 wherein said sealing member is a resilient sealing bellows comprising biasing adjusting means.

5. A system in accordance with claim 1 wherein a gas cushion vessel having a variable water level supplied by said feeding hose is mounted on said riser pipe above said ram valve for reducing pressure oscillations of water in said feeding hose.

6. A system in accordance with claim 5 wherein said gas cushion vessel is provided with electrolytical vent means and comprises an electrode which is electrically insulated from said riser pipe.

7. A system in accordance with claim 6 wherein said gas cushion vessel comprises a floating member coupled to said ram valve by mechanical coupling means, whereby a shut-off threshold force of said ram valve is controlled by said variable water level in said gas cushion vessel.

8. A system in accordance with claim 1 wherein said feeding unit comprises a conduit connecting said feeding hose and said riser pipe and including a shut-off device for compulsorily causing said ram valve to open by pressure equalization and pressure pulses in said riser pipe when said ram valve is clogged in its closed position.

9. A system in accordance with claim 1 wherein in said feeding unit said riser pipe communicates with a conduit having a valve connection for an air pump for enhancing a closing pressure difference when said ram valve is clogged in its open position.

* * * * *